US008118036B2

(12) United States Patent
Wang et al.

(10) Patent No.: US 8,118,036 B2
(45) Date of Patent: Feb. 21, 2012

(54) HAIR DYEING COMB WITH INTERCHANGEABLE COMB HEADS

(76) Inventors: Jen Chuan Wang, Hacienda Heights, CA (US); Joan Wang, Hacienda Heights, CA (US); Jonathan Wang, Hacienda Heights, CA (US)

( * ) Notice: Subject to any disclaimer, the term of this patent is extended or adjusted under 35 U.S.C. 154(b) by 757 days.

(21) Appl. No.: 12/215,178

(22) Filed: Jun. 26, 2008

(65) Prior Publication Data

US 2009/0320868 A1 Dec. 31, 2009

(51) Int. Cl.
*A45D 24/22* (2006.01)

(52) U.S. Cl. ..... 132/113; 132/112

(58) Field of Classification Search ..... 132/108–116, 132/221, 270; 222/96, 107, 490, 94–95, 222/105, 212, 192, 213; 401/268, 289, 10, 401/35, 192, 199
See application file for complete search history.

(56) References Cited

U.S. PATENT DOCUMENTS

| | | | | |
|---|---|---|---|---|
| 3,961,635 | A * | 6/1976 | Miya | 132/113 |
| 4,121,602 | A * | 10/1978 | Young | 132/113 |
| 5,738,121 | A * | 4/1998 | Westerveld et al. | 132/113 |
| 6,334,449 | B1 * | 1/2002 | Burrowes et al. | 132/114 |
| 6,457,476 | B1 * | 10/2002 | Elmer et al. | 132/114 |
| 6,691,712 | B2 * | 2/2004 | Chu et al. | 132/112 |
| 2006/0021629 | A1 * | 2/2006 | Mu et al. | 132/116 |

* cited by examiner

*Primary Examiner* — Todd Manahan
*Assistant Examiner* — Brianne O'Neill

(57) ABSTRACT

A dispensing device, having a hollow nipple-shaped stopper configured to act as a one-way valve, for use as a hair dyeing comb is provided. The nipple-shaped stopper has an aperture at its tip end. The aperture opens toward outside when the operator compresses the plastic bottle and closes when the operator releases the plastic bottle. When the aperture is in its closed position, the stopper prevents the liquid hair dye already in the conduit from flowing back to the plastic bag inside the bottle. The purpose of using the stopper here is to keep the air out of the dispensing system in order for the operator to pump the liquid dye efficiently. The stopper and a small aperture at the bottom of the plastic bottle are replacing the one-way valve currently used in many hair dye-dispensing devices. With interchangeable comb heads, the operator can choose the proper comb head for his hair type and different application purpose.

1 Claim, 6 Drawing Sheets

HAIR DYEING COMB WITH INTERCHANGEABLE COMB HEADS

CROSS REFERENCE TO RELATED APPLICATIONS

| | | |
|---|---|---|
| 3,516,424 | June 1970 | Eagle |
| 3,565,541 | February 1971 | Vallis |
| 4,254,738 | March 1981 | Stanley |
| 4,934,855 | June 1990 | Recchelbacher |
| 5,213,430 | May 1993 | Pandola |
| 5,469,873 | November 1995 | Guth |
| 5,472,456 | December 1995 | Larsky et al. |
| 5,555,899 | September 1996 | Foreman |
| 5,584,309 | December 1996 | De Beneditis et al. |
| 5,655,551 | August 1997 | Knight |
| 5,676,480 | October 1997 | Tosto |
| 5,778,902 | July 1998 | Argyle, et al. |
| 5,848,598 | December 1998 | Walz, et al. |
| 5,913,314 | October 1999 | Garrett |
| 5,937,865 | August 1999 | Dhaliwal |
| 6,000,405 | December 1999 | De Laforcade |
| 6,022,163 | February 2000 | Asfur |
| 6,065,891 | May 2000 | Rebman et al. |
| 6,257,246 | July 2001 | Kan |
| 6,357,450 | March 2002 | Paice |
| 6,367,483 | April 2002 | Chen et al. |
| 6,691,712 | February 2004 | Chu, et al. |
| 6,752,157 | June 2004 | Lu Shao Hua |
| 6,848,452 | February 2005 | Kennedy et al. |
| 6,962,158 | November 2005 | Anguelo |
| 7,044,137 | May 2006 | Glucksman, et al. |
| 7,087,095 | August 2006 | Pollack |
| 7,156,885 | January 2007 | Kennedy, et al. |
| 7,243,660 | July 2007 | Capristo |

TECHNICAL FIELD

The present invention relates to a dispensing device for use as a hair dyeing comb.

BACKGROUND OF THE INVENTION

Many prior versions of the hair dyeing applicator use the compressible bottle and a one-way valve to make the applicator work. Our design, a hollow nipple-shaped stopper combined with a small aperture, is comparably simpler and costs less. The applicator can not only prevent the liquid dye from directly contacting the scalp but also apply the hair dye at his own pace. Dyeing hair becomes a simple and no-mess job with our invention. The comb as designed accommodates many different hair types.

Someone with thin and short hair can use the comb with fewer comb teeth. Someone with dense and long hair can choose the comb head with more teeth. For hair highlighting or mustache coloring, one can choose the smaller head. Changing the comb head from one to another is as easy as detaching the old one and attaching the new one.

BRIEF SUMMARY OF THE INVENTION

The hair dyeing comb comprises a compressible plastic bottle with a small aperture at its bottom, a shaped and thermal-formed plastic bag that contains liquid hair dye, a hollow nipple-shaped stopper made of elastic plastics with an aperture at its top end, a comb body part with a conduit and a plurality of apertures and an interchangeable comb head part with teeth and canals.

The compressible plastic bottle is a common PE or PP bottle. Preferably, the bottle is bigger at its bottom and round at its shoulder. The bottle comprises a small hole at its bottom side. The bottle has an external thread on the neck of its open end. A collapsible plastic bag is encased in the plastic bottle. The plastic bag is thermal-formed to fit the size of the rim of the plastic bottle at its open end. The open end of the plastic bag has an interface member. The interface member is seated on the top side of the rim of the bottle. A hollow nipple-shaped stopper with a "+" or "−" shape aperture on its tip end is made of elastic polymer such as rubber, silicon or similar elastic capable material. The nipple part of the stopper is inserted into the open end of the conduit of the comb body part. The second end of the conduit is a close end. The base of the stopper, having a wide horizontal ring, fits into the hollow seat of the comb body. Thus, the wide horizontal ring is seated on the interface member of the plastic bag and underneath is the open end of the plastic bottle when both the comb body part and the plastic bottle are engaged. A hollow seat on the comb body part, comprising an inner thread, engages the outer thread of the plastic bottle. The wide horizontal ring of an elastic stopper tightly seals the plastic bag, preventing outside air from entering, when the comb body and the plastic bottle are tightly engaged by threads. A comb body part also comprises a conduit, a plurality of apertures, two guiding members and a stopper. Two guiding members, one on each side, are located on the opposite side of the outside wall of the conduit. The interchangeable comb head part has two grooves that are complementary in shape and size with the corresponding guiding members. The comb head is guided through the first end of the guiding members and stopped by a stopper which is at the second end of the guiding member.

DETAILED DESCRIPTION OF THE INVENTION

Figure 1:
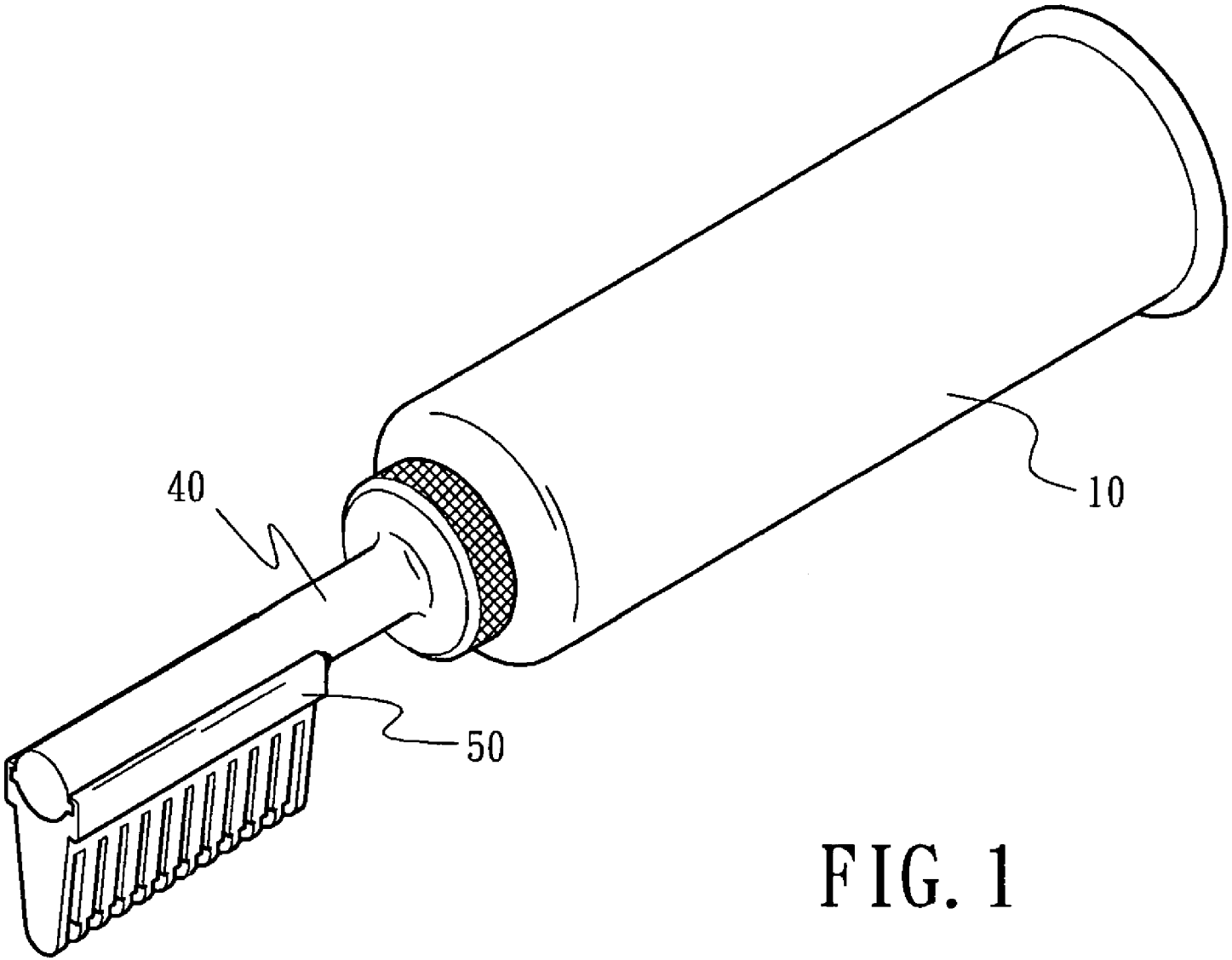
FIG. 1 is a perspective view of a preferred hair dyeing comb in accordance with the present invention.
Figure 1A:
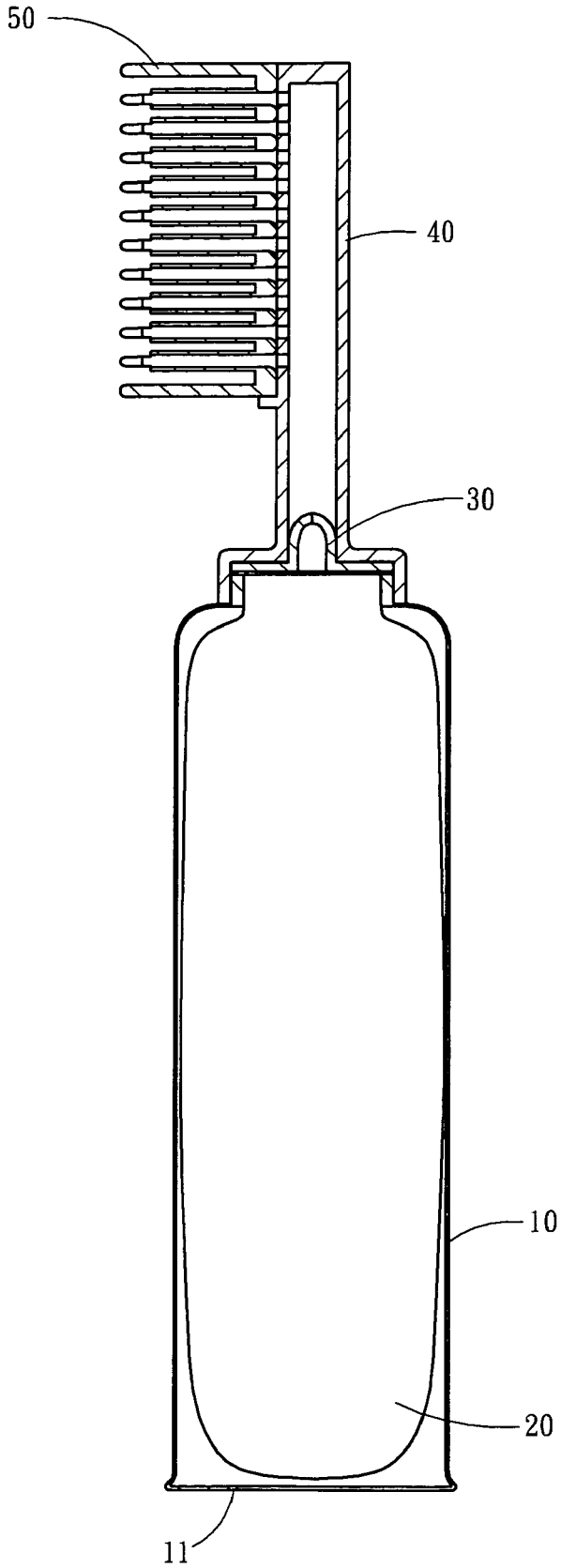
FIG. 1A is a longitudinal cross section view of a preferred hair dyeing comb in accordance with the present invention.

Referring to FIGS. 1, 1A, 2 &2B, the hair dyeing comb comprises a plastic bottle 10 which is compressible and has a small aperture 11 on it, a heat-formed plastic bag 20, a hollow nipple-shaped stopper 30 made of elastic polymers with an aperture 31 on it, a comb body part 40 which has a hollow seat 44, a conduit 41 and a plurality of apertures 42 and an interchangeable comb head part 50 which dispenses and combs the dye onto hair. The compressible plastic bottle 10 is a common shaped bottle. Preferably, the bottle has a larger bottom 13 and round shoulder 14. The whole unit stands firmly if it has a larger bottom. The size of the small aperture 11 controls the air volume that flows in and out of the plastic bottle. When squeezing the bottle, part of the air in the bottle flows out and part of the air is retained. The smaller the aperture, the more air is retained in the bottle. With more air retained in the bottle, more pressure is applied onto the plastic bag, and in turn the liquid dye inside the plastic bag will be pushed into the conduit 41 when the bottle 20 is squeezed. However, the smaller the aperture, the less amount of air will be sucked into the bottle when releasing the bottle. Therefore, more time will be needed for the bottle return to its original shape. Therefore, the size of the aperture is suitably small but should not be too small. The operator also can squeeze the bottle harder and faster in the case that more dye is needed. The bottle has an external thread 12 on the neck of its open end. A plastic bag 20 is encased in the plastic bottle 10.

Figure 2:
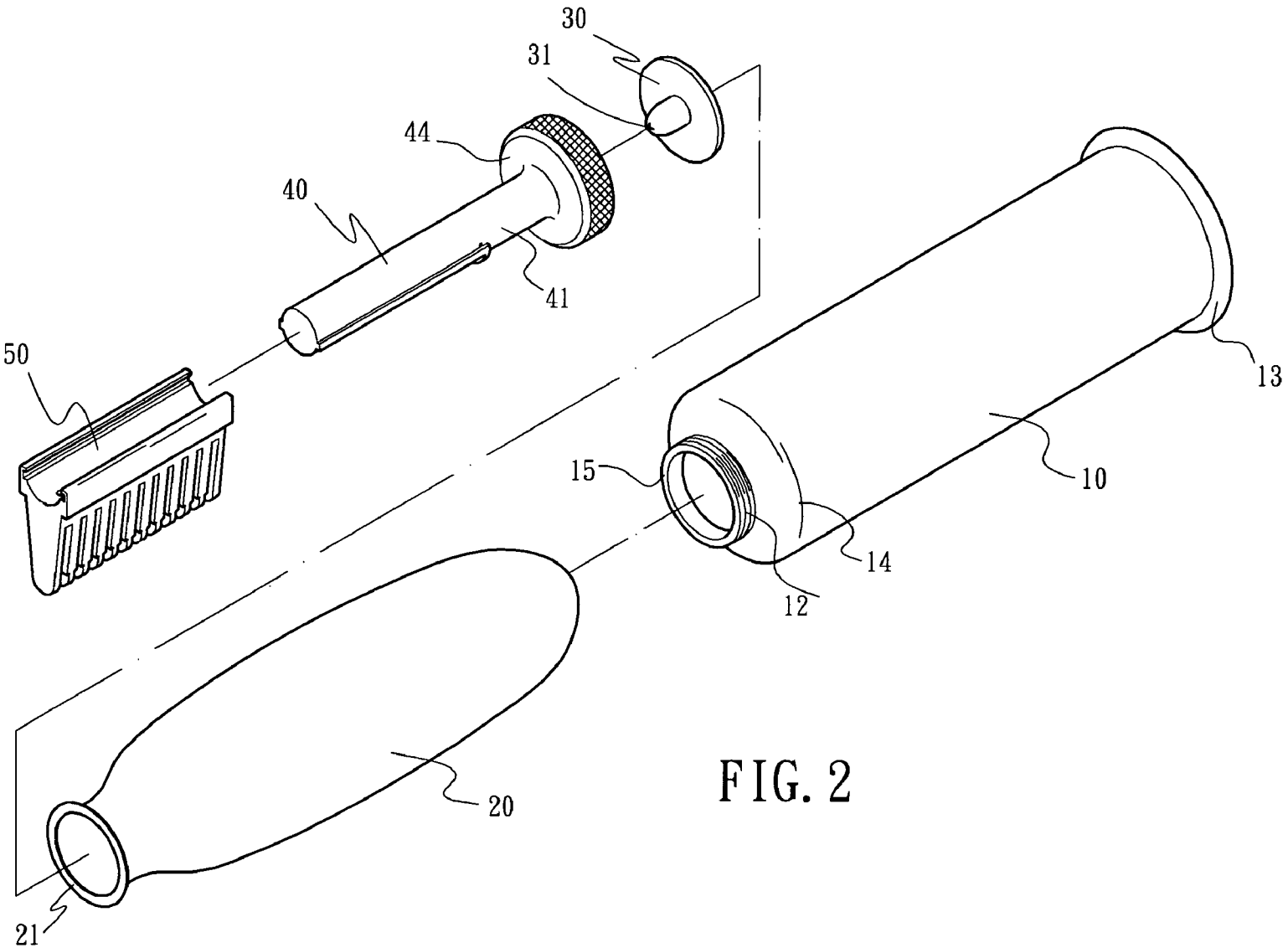
FIG. 2 is an exploded view of all parts of a preferred hair dyeing comb in accordance with the present invention.
Figure 2A:
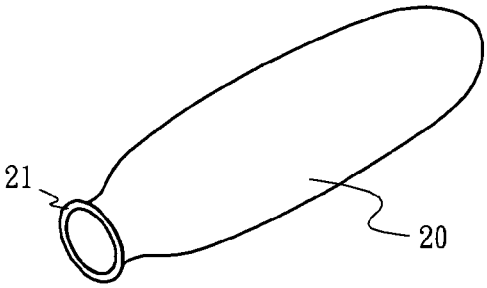
FIG. 2A is a perspective view of a plastic bag of a preferred embodiment in accordance with the present invention.
Figure 2B:
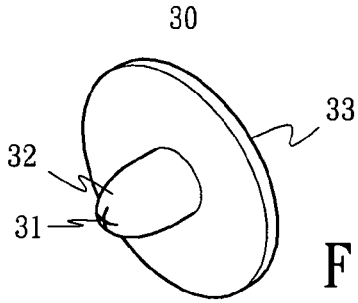
FIG. 2B is a perspective enlarged view of a hollow nipple-shaped stopper of a preferred embodiment in accordance with the present invention.
Figure 2C:
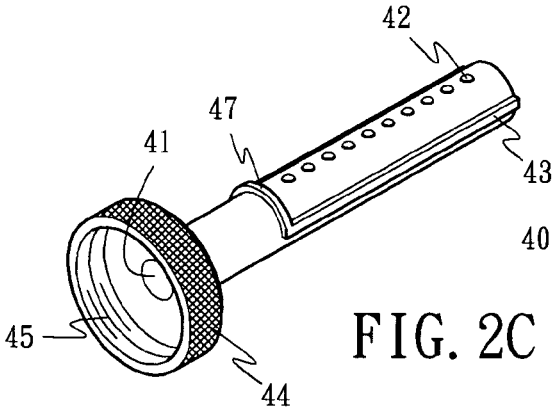
FIG. 2C is a perspective view of a comb body of a preferred embodiment in accordance with the present invention.
Figure 2D:
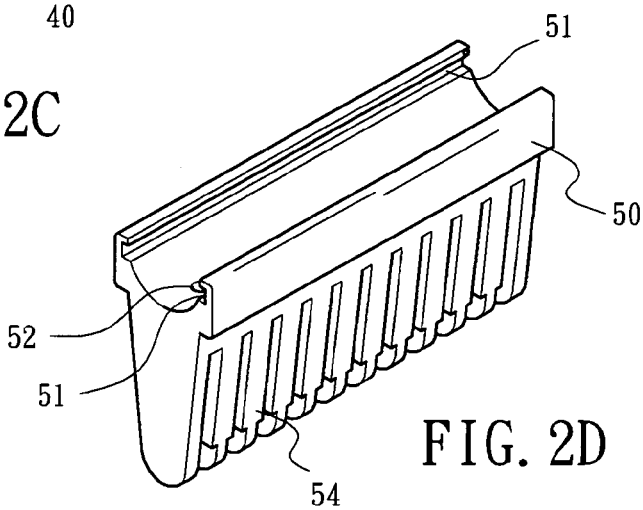
FIG. 2D is a perspective view of an interchangeable comb head of a preferred embodiment in accordance with the present invention.
Figure 2E:
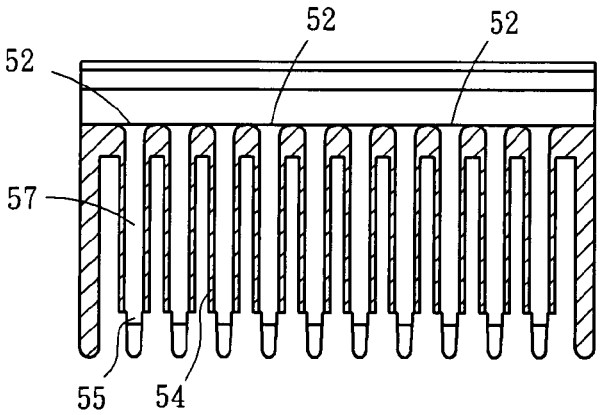
FIG. 2E is a side cross section view of a comb tooth head showing detailed canals and openings of a preferred embodiment in accordance with the present invention.

Referring to FIGS. 2 & 2A, the plastic bag 20, having an interface member 21 at its open end, is thermal-formed and cut to fit the mouth 15 of the plastic bottle. The interface member 21 is seated and adhered on the top side of the mouth 15 of the bottle 10. Referring to FIGS. 2, 2B & 2C, a hollow nipple-shaped stopper 30 with a "+" or "−" shape aperture 31 on its tip end is made of elastic polymer such as rubber, silicon or similar material. The aperture opens toward the outside and closes toward inside. The nipple part 32 of the stopper 30 is inserted into the open end of the conduit 41 of the comb body part 40. The wide base ring of the stopper 33 fits into the hollow seat 44 of the comb body 40. Accordingly, the base ring of the stopper 33 is seated on the interface member 21 of the plastic bag 20 which is seated on the top side of the mouth 15 of the plastic bottle when the comb body part 40 and plastic bottle 10 are engaged by thread. The comb body part 40 comprises an inner thread 45 at its first end and engages the outer thread 12 of the plastic bottle. No air leaks into the plastic bag 20 through the hollow seat 44 and the wide base ring 33. In addition to the hollow seat, a comb body part 40 also comprises a conduit 41, a plurality of apertures 42 and two guiding members 43. Two guiding members 43, one on each side, are on the outside wall of the conduit. Referring to FIGS. 2C, 2D & 2E, the comb head part 50 comprises two grooves 51 and these two grooves 51 are in a complementary shape and size with those two guiding members 43. When putting on the interchangeable comb head, the comb head part is guided through the first end of the two guiding members 43 and stopped at its second end by a stopper 47. A plurality of apertures 52 on the comb head part 50 are precisely numbered and positioned to match up with the corresponding apertures 42 on the comb body part 40. The aperture 52, meanwhile, is on the first end of the canal 57, which is at the center of each tooth 54. It has a slightly larger reception area to make sure of a clear passage of the hair dye from the aperture 42 of the comb body part to the canal 57. The second end of the canal is an opening 55. The opening 55 is where the dye comes out to both sides of the comb tooth 54 and is located 3 to 6 millimeters from the tip of the tooth. The comb head part 50 is interchangeable.

Figure 3A:
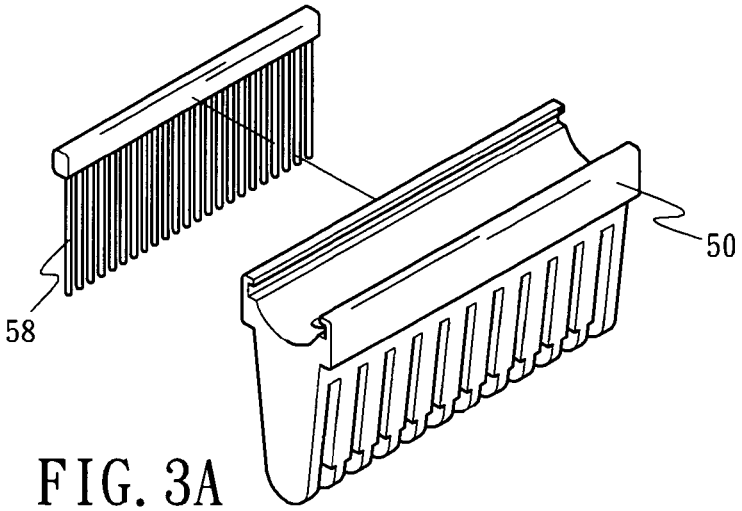
FIG. 3A is perspective exploded view of another interchangeable comb head designed with more comb teeth of a preferred embodiment in accordance with the present invention.
Figure 3B:
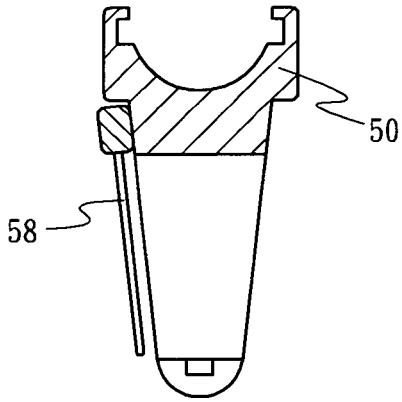
FIG. 3B is an end view of an interchangeable comb head designed with more comb teeth of a preferred embodiment in accordance with the present invention.
Figure 3C:
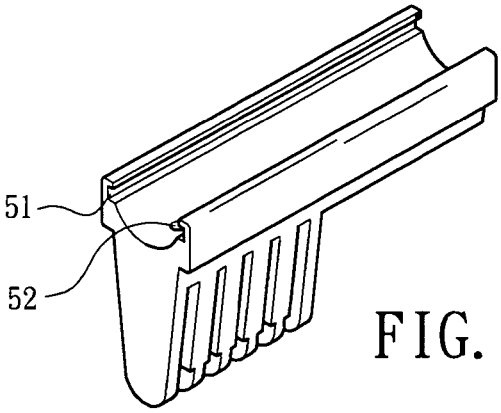
FIG. 3C is a perspective view of another interchangeable comb head designed with fewer comb teeth of a preferred embodiment in accordance with the present invention.
Figure 3D:
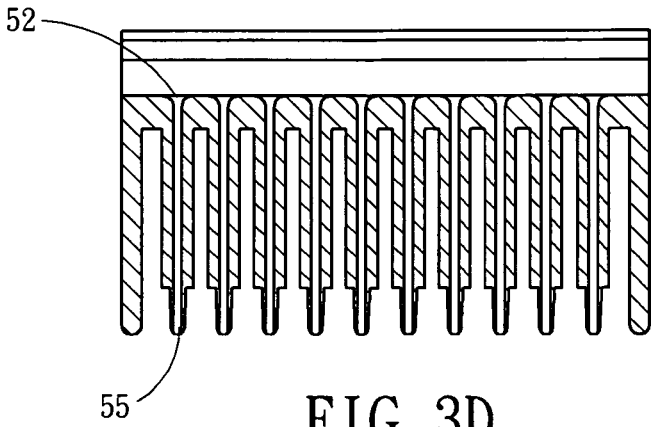
FIG. 3D is an side cross sectional view of another interchangeable comb head designed with the openings extended to the tip of the tooth of a preferred embodiment in accordance with the present invention.
Figure 4:
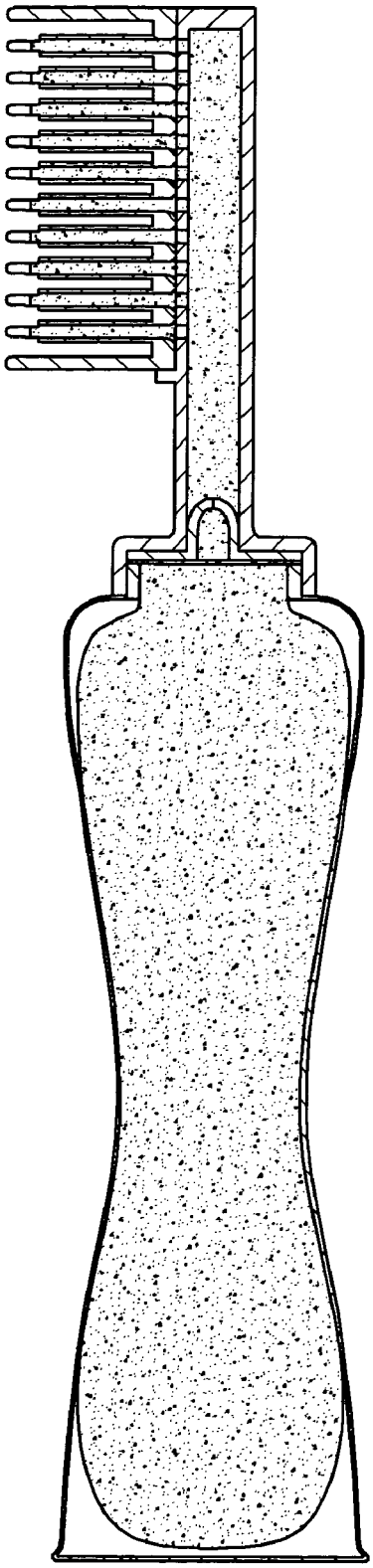
FIG. 4 is a longitudinal cross section schematic view of a compressed bottle form of the hair dyeing comb, also showing the position of liquid dye, of a preferred embodiment in accordance with the present invention.
Figure 5:
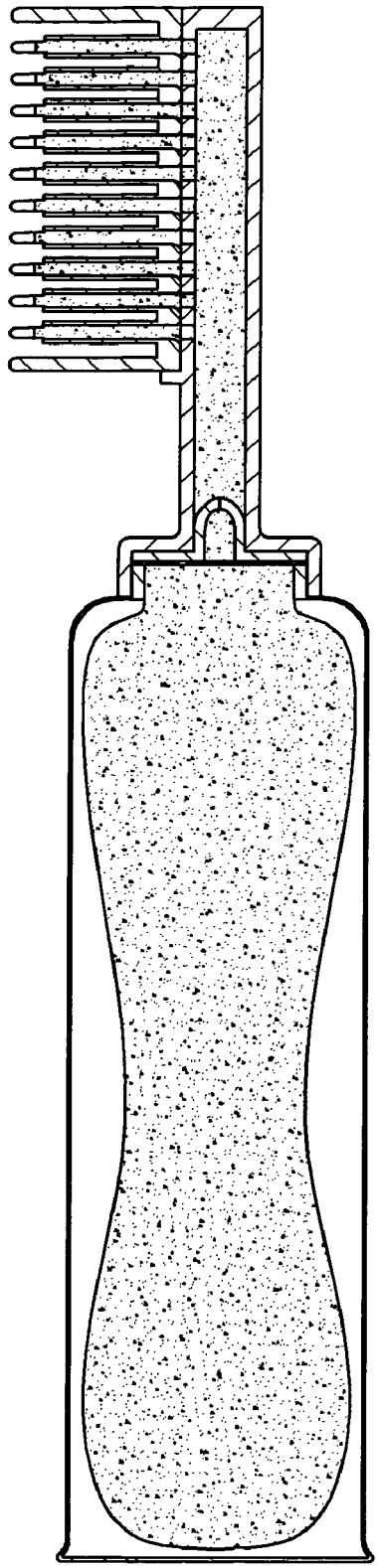
FIG. 5 is a longitudinal cross section schematic view of a released bottle form of the hair dyeing comb, also showing the position of liquid dye, of a preferred embodiment in accordance with the present invention.

Referring to FIGS. 3A & 3B, an extra comb section 58 adhered to the flat side of the regular comb head 50 representing a more teeth comb head. Referring to FIG. 3C, a comb head comes with fewer comb teeth; thus, fewer apertures 52 are presented on the comb. Referring to FIG. 3D, comb teeth part designed with all opening 55 extended to the tip of the tooth. The operator can choose among our four preferred designs of comb head 50 to accommodate different hair types and application purposes. FIG. 4 shows the position of liquid dye when the plastic bottle is compressed and FIG. 5 shows the position of liquid dye when the plastic bottle is released.

The unit comes assembled. The comb tooth part, the comb body part and the hollow nipple-shaped stopper are assembled together. The interface member of the plastic bag can be pre-adhered to the mouth of the plastic bottle. First, the operator fills the plastic bag with liquid hair dye and engages the plastic bottle and the comb body. Since the hollow nipple-shaped stopper that connects is made of elastic polymer, the whole dispensing system becomes air-tight after the two parts are engaged. Then, the operator should compress the bottle a few times to fill the conduit and canals with liquid dye before applying. There will be enough time for the operator to comb his hair a few more times between pumps. The operator can comfortably control the dye dispensing speed by adjusting the force and quickness of each compression. People with more hair can replace the comb with one that includes more teeth. A comb with more teeth benefits the operator by requiring fewer comb strokes, which shortens the overall hair dyeing time. Another design of the comb head allows the direct application of hair nutrient or shampoo onto the scalp with the opening of the canal extended to the tip. For partial hair dyeing or highlighting, a comb head with fewer comb teeth can be chosen. The comb heads are interchangeable.

The invention is not limited to the above embodiment but various modifications thereof may be made. Further changes in form and detail may be considered without departing from the scope of this invention.

The invention claimed is:

1. A hair dyeing comb with interchangeable comb heads comprising:

a compressible plastic bottle having a top end and a closed bottom end wherein the top end comprises an externally threaded neck forming an opening and the bottle comprises a small aperture;

a thermal formed plastic bag encased in the plastic bottle and fitted onto the neck of the bottle, configured to retain hair dye;

a hollow nipple shaped stopper attached to the neck of the plastic bottle, where the nipple has a top end defined by a tip and an open bottom end to fluidly connect to the neck of the bottle, and a slit located on the tip;

a hollow cylindrical comb body longitudinally extending from a threaded cap toward a distal end; the body having an open end comprising a conduit that extends the length of the comb body; wherein the tip of the nipple shaped stopper is configured to be inserted into the conduit; the comb body additionally comprising a row of aligned apertures that extend longitudinally along a single side of the comb body; wherein the apertures open into the conduit; a pair of flanged guide members that extend along both sides of the length of the comb body containing the apertures; a transversely extending guide flange located between the row of apertures and the cap that connects ends of the guide members;

a comb head formed by a base with a recess adapted to mate with a portion of the comb body; a row of hollow teeth; each tooth further comprising:

a conduit that communicates with the recess and extends through the tooth to a pair of opposing apertures located a distance from a distal end of the tooth; the apertures of adjacent teeth face each other;

the comb head further comprising a pair of longitudinally extending grooves that extend along either side of the recess to slidingly engaging the guide flanges of the comb body to allow for the comb head to attach to the comb body, such that the apertures of the comb body and the comb head align with each other; whereby such an engagement is removable.

* * * * *